United States Patent [19]

Guhlin

[11] 4,121,948

[45] Oct. 24, 1978

[54] UNIVERSAL FLUSHING APPARATUS

[76] Inventor: Kjall G. Guhlin, 11727 Sheridan, Houston, Tex. 77050

[21] Appl. No.: 773,902

[22] Filed: Mar. 3, 1977

[51] Int. Cl.[2] ..... B08B 3/02; B08B 9/00

[52] U.S. Cl. ..... 134/100; 134/167 R; 134/169 A; 115/75

[58] Field of Search ..... 134/100, 102, 167 R, 134/168 R, 169 A; 123/41.42, 41.43; 115/75

[56] References Cited

U.S. PATENT DOCUMENTS

| | | | |
|---|---|---|---|
| 1,887,985 | 11/1932 | Auker et al. | 134/102 X |
| 2,679,851 | 6/1954 | Schira, Jr. | 134/102 |
| 2,835,234 | 5/1958 | Rasch et al. | 134/169 A X |
| 3,320,964 | 5/1967 | Tripp | 134/100 |
| 3,931,828 | 1/1976 | Lawler | 134/169 A X |
| 4,065,325 | 12/1977 | Maloney | 134/167 R |

*Primary Examiner*—Robert L. Bleutge
*Attorney, Agent, or Firm*—Michael L. Parks

[57] ABSTRACT

An apparatus adapted for adjustable mounting on boat motors having different sizes and locations of cooling intakes for flushing and controllably introducing fluids into the cooling system of such boat motors and further having fluid conducting members for providing a stream of fluid for introduction into the boat motors, and a fluid introducing member releasably attached to the cooling intake of the boat motor for introducing a stream of fluid into the cooling system and a control member connected to the fluid introducing member and in fluid communication with the conducting member for controllably introducing fluid into the cooling system of a boat motor.

10 Claims, 11 Drawing Figures

UNIVERSAL FLUSHING APPARATUS

BACKGROUND OF THE INVENTION

This invention relates to an apparatus which is adapted for adjustable mounting on boat motors for flushing and controllably introducing fluids into the cooling system of boat motors which have different sizes and locations of cooling intakes on the housing of such boat motors.

While it is old in the art to provide apparatus for connection to boat motors for flushing, the prior art flushing apparatus have either been too flexible or too rigid in their mounting on the boat motors. For example, U.S. Pat. No. 3,931,828 issued to Roger J. Lawler, U.S. Pat. No. 2,644,474 issued to F. M. Houchin, and U.S. Pat. No. 2,611,631 issued to O. B. Benson, are some patents which demonstrate some of the problems with the prior art.

If the apparatus of the prior art were too flexible, they were subject to slipping from the housing of the boat motor as the fluid is introduced to flush the motor, which is the case in such mounting devices which utilize the U-shaped clamp of the Lawler prior art. Other prior art which utilizes a more rigid connecting means to eliminate problems of leakage around the cooling intake ports while injecting the fluid into the cooling intake of the motor, is such prior art as Benson and Houchin's. But, by the very necessity of the rigid connection to the boat motor, by Benson and Houchin type connectors, the connectors must be adapted to fit a particular boat motor. Also, the cooling intakes are generally located in different positions on different boat motors and thus, the flushing device of Benson will not fit the boat motor adapted to receive the Houchin flushing device because they are rigidly connected in different ways and cannot be adapted for motors which are not set up to handle their particular flushing devices. Nor can these rigid connectors be adapted to fit on different motors because the cooling intakes of different motors are in different locations on different motors and have different size openings.

Also, in the prior art devices, the rigidly mounted devices are generally hard to attach and require a substantial amount of time to be mounted to the motor. Also, after the flushing of the motor, a great quantity of time is required to disconnect these devices from the motor. Thus, in all the prior art no provision has been made for a universal flushing apparatus which will fit a large number of different types of boat motors which have their cooling intakes at different positions and locations on the boat motor and can be readily and easily connected and disconnected without requiring large amounts of time.

Further, the prior art has not provided for a means of controlling the flow of fluid at the boat itself, and they have generally relied on a hydrant connection or faucet, which in many cases are remote from the place of flushing the boat motor. The problem with having the water control remote from the motor is that it eliminates the ability to control the flow of water while, at the same time, controlling the speed of the boat motor during flushing. This creates the problem of having to go from the motor to the remote faucet in order to adjust the flow of water to the motor speed at which the motor is being flushed.

Also, the prior art has made no provision for any means of introducing fluid or fluids or fluid additives for coating the motor as the motor is being flushed of the impurities which are picked up by the motor during its normal operation in lakes and oceans.

OBJECTS OF THE INVENTION

It is the object of this invention to provide a ready-releasable flushing apparatus for providing a relatively fixed mounting over the cooling intakes of a boat motor for flushing the cooling system of a boat motor.

It is the further object of this invention to provide a ready-releasable flushing apparatus which, when attached, does not allow a great quantity of leaking around the cooling intakes of the boat motor.

It is yet another object of this invention to provide a flushing apparatus which is rapidly and easily attached to the boat motor and the cooling intakes of the boat motor for rapid set-up and taking down of the flushing apparatus.

It is yet another object of this invention to provide a flushing apparatus which is adaptable for adjustable mounting on boat motors having cooling intake ports located at various positions on the boat motor to provide a universal flushing apparatus which can be used on many boat motors.

Another object of this invention is to provide a control of the fluid flow at the flushing apparatus to allow the control of the fluid flow in relation to the speed at which the motor is being flushed.

It is yet another object of this invention to provide a flushing apparatus which can be adapted for the addition of anti-corrosion and rust-inhibiting additives into the cooling system simultaneously with the flushing of the motor, such that a film of these additives can be left after the flushing of the motor cooling system has occurred.

It is yet another object of this invention to provide a flushing apparatus which is adaptable to fit motors having cooling intakes of different sizes and locations on the motors.

These and other more specific objects will appear upon reading the following specifications and claims and upon consideration, in connection therewith, the attached drawings to which they relate. Referring now to the drawings of the invention:

Figure 1:
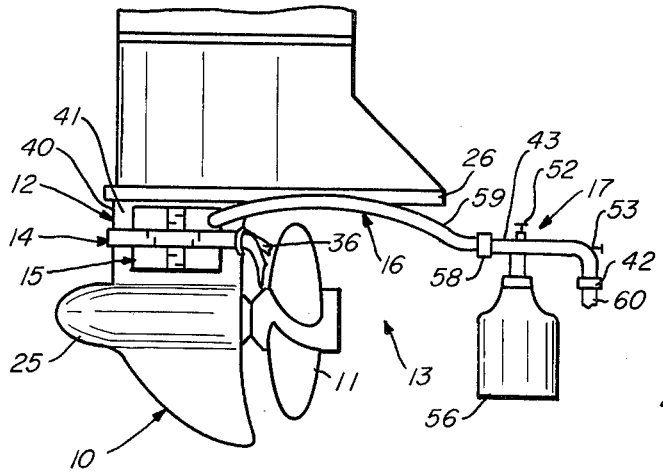
FIG. 1 is a lateral view of the flushing apparatus of this invention connected to one size and location of cooling intake on a boat motor.
Figure 11:
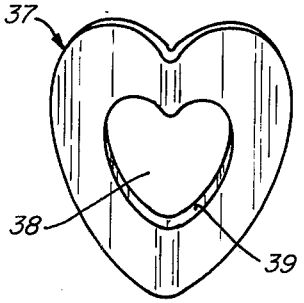

FIG. 11 is a perspective view of the V-shaped, washer-like member. Referring more particularly to FIG. 1, there is shown a typical boat motor 10 having a propeler 11 and a motor housing extension 12 with the apparatus of this invention generally indicated at 13 mounted over the cooling intakes of the boat motor 10.

It can be seen from FIG. 1 that the apparatus of this invention 13 is connected to the boat motor 10 by a readily releasable fastener 14, which holds a fluid introducing member 15 in place over the cooling intakes of the boat motor 10. Connected to the fluid introducing member 15 is fluid conducting member 16 which is further connected in fluid communication with a control member referred to generally at 17.

The operation of the apparatus of this invention is such that a flushing fluid is provided through fluid conducting member 16 which is in fluid communication with the control member 17 for controllably introducing fluid into the fluid introducing member 15 for that fluids introduction into the cooling system of boat motor 10. The purpose of the introduction of the fluid into the boat motor 10 is to remove silt and salt deposits or other foreign materials, which if allowed to remain in the cooling system of a boat motor will reduce its cooling efficiency and potentially form a blockage in the cooling system itself.

Figure 3:
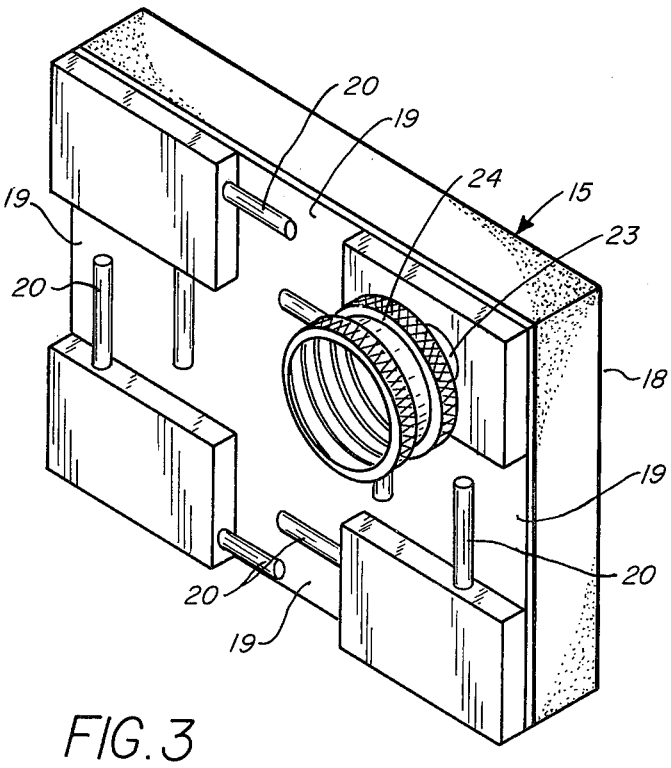
FIG. 3 is a perspective view of one embodiment of a fluid introducing pad member of this invention.

In at least one embodiment of this invention as shown in FIG. 3, the fluid introducing member 15 comprises a sealing surface 18 on one side and a slotted member 19 on the other side of the fluid introducing member 15. The slotted member 19 is for providing slots to receive the ready releasable fastener 14 which, when attached to the boat motor 10, holds the fluid introducing member 15 in place over the cooling intakes of the boat motor 10.

Projecting into the slots of slotted member 19 are prongs 20 to help maintain the ready releasable fastener 14. If these prongs 20 were not present, the motor vibrations might cause the fluid introducing member 15 to become disengaged from the ready releasable fastener member 14.

Figure 4:
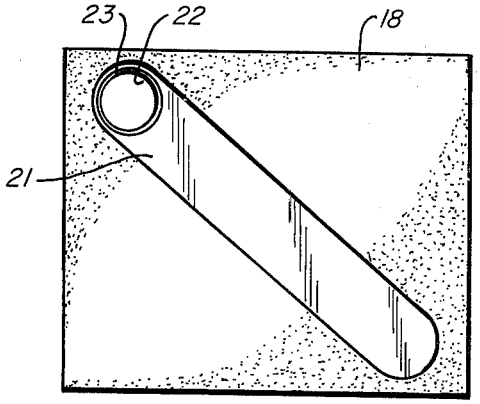
FIG. 4 shows one side of the fluid introducing pad member, having a channel formed along the sealing surface.

On the sealing surface 18, as shown in FIG. 4, there is provided a diagonal channel 21 for providing fluid communication with the cooling intakes on boat motors which have the cooling intakes located in different locations on the motors. It should be noted that the fluid introducing member 15 is in the form of a rectangle which can be rotated for mounting to a motor in either a lengthways or sideways position to further allow this fluid introducing pad to fit over varied cooling intakes on varied motors. In FIG. 1 the fluid introducing member 15 is mounted in a sideways position, while in FIG. 2 the fluid introducing member 15 is mounted lengthways and to the front edge of the boat motor 10. It should be understood that with the diagonal channel 21 running diagonal to both the lengthways and sideways position of the fluid introducing member 15, that the diagonal channel 21 will be in fluid communication when mounted in either position. Also, by providing fluid communication only along the diagonal channel 21, there is provided a larger quantity of sealing surface 18 on the fluid introducing member 15 for forming a better seal over the cooling intake of motor 10. Yet another benefit in being able to rotate the fluid introducing member 15 from a sideways position or lengthways position can be further seen by comparing the housings 12 of boat motors 10 in FIGS. 1 and 2 because the outboard motors of these figures have different locations and sizes of cooling intakes and yet this fluid introducing member 15 fits both. It should be noted that in FIG. 1 the distance between the propeller housing 25 and the ridge 26 of the motor housing extension 12 is a very small distance and the fluid introducing member 15 would be too large to be mounted lengthways and, therefore, must be mounted in a sideways position. While in FIG. 2, the cooling intake of this outboard motor 10 is located at the front edge of the outboard motor 10 and the distance between the propeller housing 25 and the ridge 26 is somewhat greater, thus it is advantageous for forming a better seal to turn the fluid introducing member 15 lengthways and move it to the front edge of the motor housing extension 12. From the above description it can be seen that the fluid introducing member 15 of this invention can be adapted to fit many sizes and shapes of cooling intakes which may be located anywhere along the motor housing extension 12 between the ridge 26 and the propeller housing 25.

In FIG. 4 it can be seen that diagonal channel 21 has an aperture 22 therethrough which is in fluid communication with the fluid conducting member 16. In at least one embodiment of this invention, a tube 23 is inserted into the aperture 22 to form an extension of the communicating channel for the purpose of placing a standard hose fitting 24 at the end thereof for easy attachment of the fluid conducting member 16.

Figure 5:
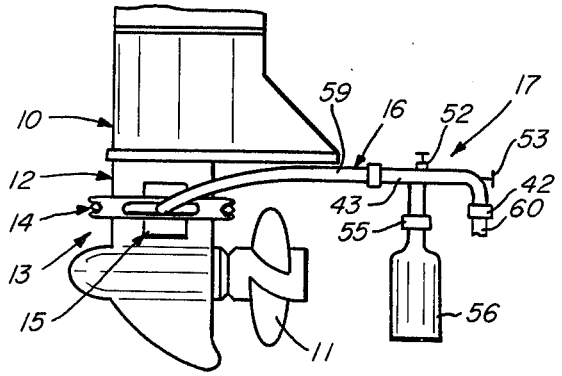
FIG. 5 shows a lateral view of yet another embodiment of this invention wherein the fluid introducing pad member is held in place by a pair of members having slotted channels.
Figure 7:
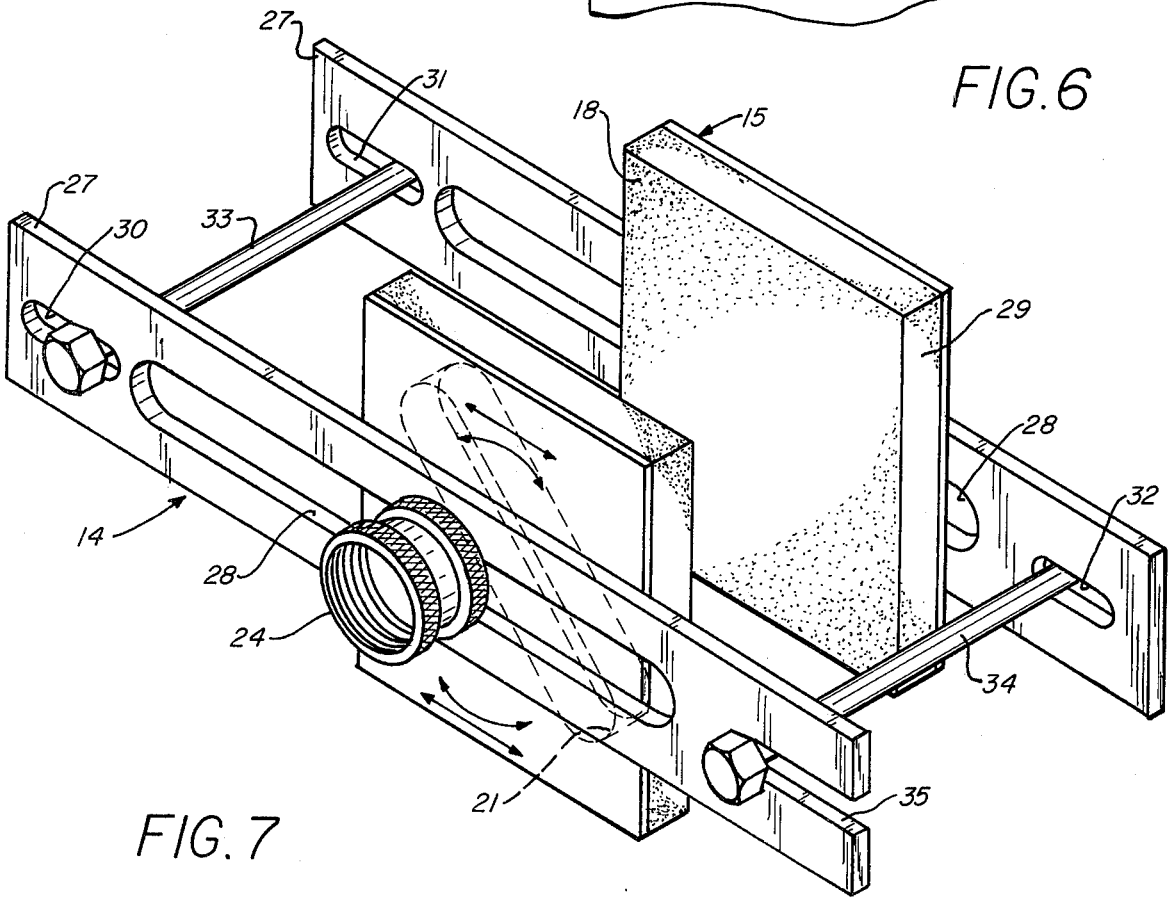
FIG. 7 is a perspective view of the fluid introducing pad member connected to a pair of members having slotted channels for sliding the fluid introducing pad members to different positions for covering the cooling intakes of various boat motors.
Figure 8:
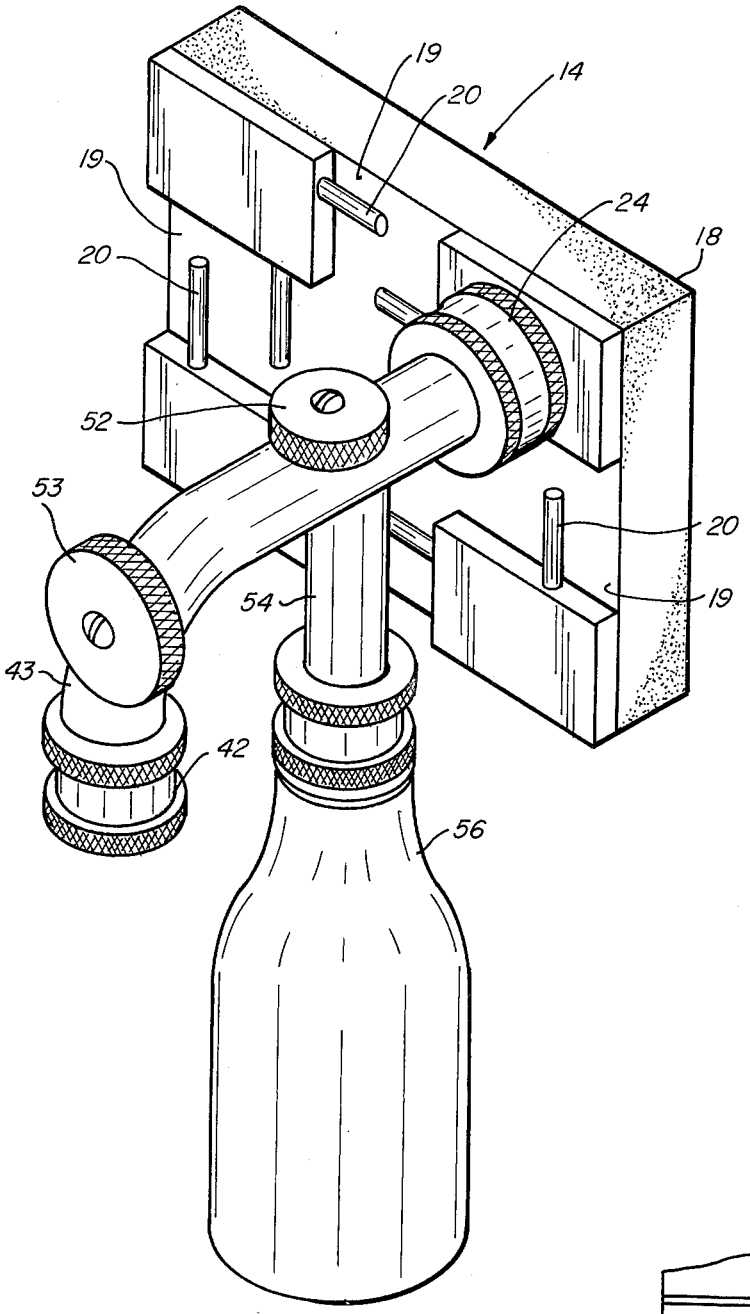
FIG. 8 shows yet another embodiment of the fluid introducing pad member as connected to the conducting member and the control member for selectively introducing fluid into the fluid introducing pad member.

In yet another embodiment, as shown in FIGS. 5 and 7, the ready releasable fastener members 14 are formed from paired members 27 which have slotted portions 28 for slidably moving said fluid introducing member 15 therealong for fitting over various sized and located cooling intakes. In this embodiment the fluid introducing members 15 are held in place in the slotted portion 28 by the mounting of a hose fitting 24 over the tube 23, which is in fluid communication with the diagonal channel 21 which is shown as dotted lines in FIG. 7.

It can also be seen from FIG. 7 that the sealing surface 18 on one fluid introducing member 15 may be a blank sealing surface (having no diagonal channel) if cooling intakes are located on both sides of the housing. This blank sealing surface 18 thus closes the other cooling intake which would lose water if not sealed while the other fluid introducing member 15 was trying to introduce fluid into the cooling system. This blank sealing surface 18 is fastened by a brad which is not seen in FIG. 7 but which extends through the slotted member 28 for slidable movement along said slotted member 28 to be in position with the fluid introducing member 15 over the cooling intakes of a boat motor.

The paired members 27 are further provided with apertures 30, 31 and 32 for receiving bolts 33 and 34. However, the bolt 34 which passes through aperture 32 on one end is fitted through a U channel 35 on the other end of a paired member 27 for ready releasable fastening of the bolt 34 without having to completely unscrew the bolt 34 and remove it from aperture 32. This U-shaped channel 35 thus allows for the easy connecting and disconnecting of the paired members 27 for rapid attaching of the apparatus 13 of this invention to a boat motor cooling intake.

Figure 2:
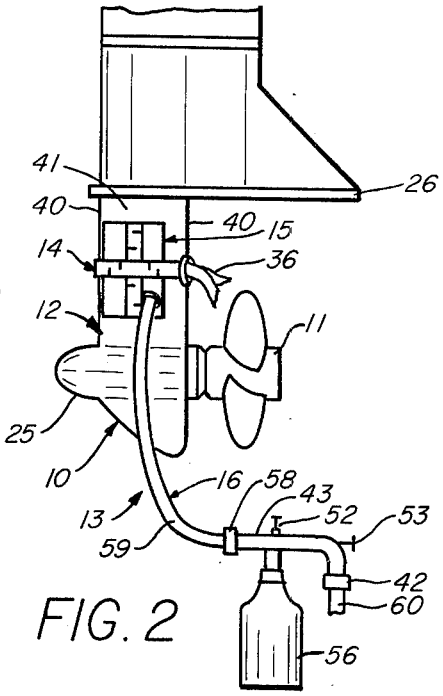
FIG. 2 is a lateral view of the flushing apparatus of this invention mounted on another size and location of boat motor cooling intake.
Figure 9:
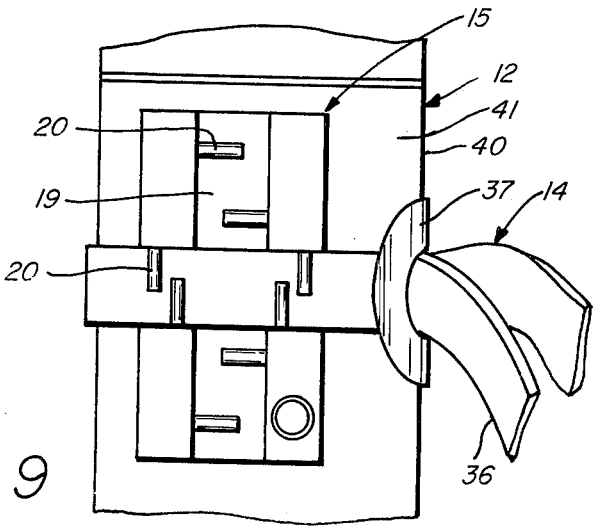
FIG. 9 shows one embodiment of a readily releasable fastener for holding the fluid introducing pad member on a boat motor wherein an elastic member in combination with a V-shaped washer-like member serves as a fastener member.

In yet another embodiment, as that shown in FIGS. 1 and 2, the ready releasable fastener 14 can be formed from an elastic member 36 which can be wrapped about the motor housing extension 12 and then fitted through the slotted member 19 of fluid introducing member 15 to be held in place by a fastener member 37, as shown in FIGS. 1, 2 and 9.

In the embodiment using the elastic member 36 and fastener member 37, there is attained a readily releasable fastener 14 which attains its fastening by pulling the elastic member 36 through fastener member 37 and pushing fastener member 37 against the motor housing extension 12. To release this fastener member 37 elastic member 36 is pulled with one hand and the fastener member 37 is moved away from the motor housing 12 while the elastic member 36 is stretched such that when tension is let off elastic member 36 the elastic member 36 and fastener member 37 are moved away from the motor housing extension 12, and the entire elastic member 36 is left loose on the motor housing extension 12.

Figure 10:
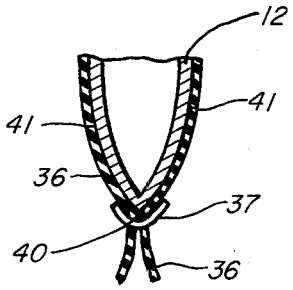
FIG. 10 is a schematic cross-sectional view of the elastic member and washer-like member showing how the V-shaped washer-like member fastens the elastic member on the outboard housing.

In FIGS. 10 and 11, the fastener member 37 can be seen to be formed from a washer-like member which is formed into a V shape and has an aperture 38 through which the elastic member 36 is placed. In FIG. 10 there is a schematic drawing of the theorized operation of this fastener member 37. It is theorized that the elastic member 36, which is at least larger than the aperture 38 of the fastener member 37, engages the inside edges 39 of the fastener member 37 between the motor housing extension 12 to form a friction-engaging point. Also, as elastic member 36 is pulled it is caused to become elongated and therefore allows elastic member 36 to be pulled through the fastener member 37 but, when the tension is let off, the elastic member 36 returns to its original shape thereby drawing down on the edge 39 which then binds against motor housing extension 12. While this theory is not fully understood it has been found to be an effective means of attaching the apparatus 13 of this invention to boat motors.

By the nature of the shape of fastener member 37, it has been found to be better adapted for fitting over the pointed edges 40 of the motor 10. Also, it has been found that by tightening the elastic member 36, over the pointed portion of the motor 10, the elastic member is prevented from being loosely fitted on motor housing 12 on one side and tight on the other which tends to occur if fastened on the flat sides 41 of the motor housing 12.

Figure 6:
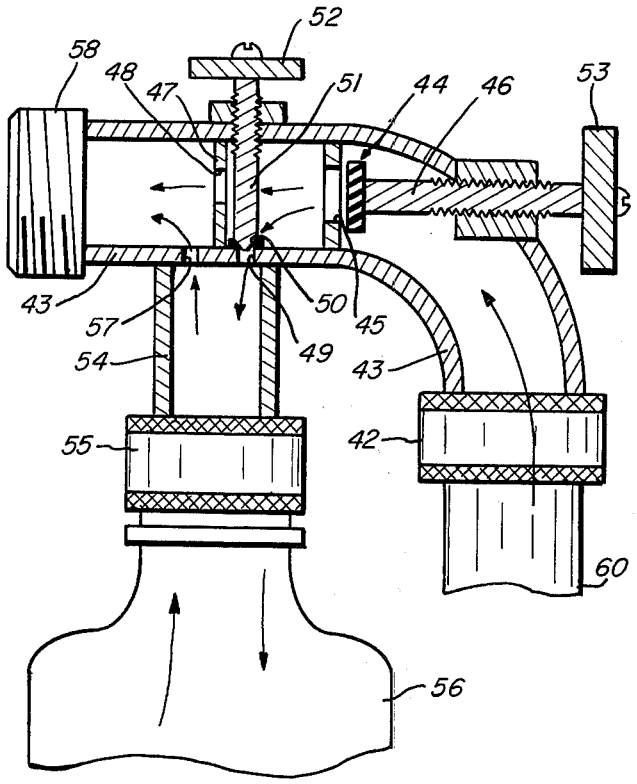
FIG. 6 is a cross-section of the control member which is connected to the fluid introducing member for controllably introducing the fluid into the fluid introducing pad member.

The control member 17, as shown in FIG. 6 of this invention, comprises in at least one embodiment a standard hose fitting 42 for receiving a fluid conducting member 16 such as a hose into fluid communication with the control member 17. The fluid conducting member 16 is placed in fluid communication with a tubular channel 43 of the control member 17 which feeds to a control valve 44 of the control member 17.

The control valve 44 has a seat member 45 formed in the tubular channel 43 and a valve stem 46 which seats and unseats to open and close channel 43 in fluid communication. This valve stem 46 is actuated from outside tubular channel 43 by an actuator 53. It should be noted that hose fitting 42 and tubular channel 43 proximate thereto are curved downward so when a hose 60 is fitted thereon no excessive stress is placed on the apparatus 13 of this invention by the weight of the hose except that weight of hose from the connection straight down to the ground. Also formed in channel 43 is a block 47 having an aperture 48 therethrough for creating a back pressure in the tubular channel 43, but which still allows flow through tubular channel 43. Between the control valve 44 and the block 47 an aperture 49 is formed in tubular channel 43. About this aperture 49 is formed a seating surface 50 for receiving a valve stem 51 to open and close said aperture 49 to fluid communication with tubular channel 43. This valve stem 51 is actuated by activator 52 which is located outside tubular channel 43. Connected in fluid communication with tubular channel 43 when aperture 49 is open to tubular channel 43 is tubular channel 54 which has a standard hose fitting 55 attached thereon and connected onto the hose fitting 55 is a container 56 for retaining fluids. When tubular channel 54 is in fluid communication with tubular channel 43, the container 56 is also placed in fluid communication with the tubular channel 43 for flowing fluid therein and therefrom.

Inside the connecting locations of tubular channel 43 with tubular channel 54 and on the other side of block 47 from the aperture 49 is provided yet another aperture 57 which is in fluid communication with tubular channel 54 and tubular channel 43 for the flowing of fluid out of the container 56 and tubular channel 54 into tubular channel 43 for introduction of said fluid into the fluid introducing member 14. The tubular channel 43 can be connected to fluid introducing member 14 by a male hose head 58 which can be screwed into the standard hose fitting 24 on the fluid introducing member 14 or a splice hose 59 may be used which then is an extension of tubular channel 43 to the point of connection of said channel to fluid introducing member 14 when that is desired.

By way of explanation, it should be understood that a fluid conducting member such as garden hose 60 is connected to a hose fitting 42 and the valve 44 is positioned to a non-communicating position or closed. Then the hose 60 is filled with fluid, such as water, to allow a pressure to build up behind the closed valve 44. Then the boat motor is turned on and the valve 44 is opened to flow water into the cooling intakes of the boat motor. This flowing of water to the boat motor must thus flow water through tubular channel 43 to the block 47 where a back pressure is created which, when aperture 49 is open, allows water to flow through aperture 49. However, water flows through aperture 48 of block 47 into channel 43 whether aperture 49 is open or closed; but, when aperture 49 is open, the water flows into container 56 where oil or other rust and corrosion inhibitors may be provided for flushing into the cooling system of boat motor so that a film or coating may be left on the internal portion of the cooling system. Thus, after an engine is sufficiently flushed, a film such as oil can be placed over the inside of the cooling surface of the engine to inhibit rust or other corrosion. Thus it can be seen that the flushing apparatus of this invention provides a means for readily flushing and providing easy attachment to the engine, but also provides a means for coating the inside of an engine with a rust inhibitor. While the particular flushing accessories for outboard motors herein shown and disclosed in detail is fully capable of attaining the objects and providing the advantages hereinfor stated.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. An apparatus adopted for adjustable mounting on motors having different size and location of cooling intakes for flushing and controllably introducing fluids into the cooling system of said motors, comprising (a) conducting means for providing a stream of fluid for introduction into said motor;

(b) fluid introducing pad means releasably attached to the cooling intakes of said motor for forming a seal for the introduction of fluid into said cooling intakes of said motor;

(c) readily releasable fastener means connected to said fluid introducing pad means for securing said fluid introducing pad means over the cooling intakes of said motor;

(d) a dispenser means connected to said fluid introducing pad means for controllably dispensing fluid; and (e) a control valve means connected to said dispenser means in fluid communication with said conducting means for controllably introducing fluid into the cooling system of said motor.

2. An apparatus adopted for adjustable mounting on motors having different size and location of cooling intakes for flushing and controllably introducing fluids into the cooling system of said motors, comprising (a) conducting means for providing a stream of fluid for introduction into said motor;

(b) a fluid introducing pad means having a seal on one side of said fluid introducing pad means and a channel formed in said seal for fluid communication with said fluid conducting means and the cooling intakes of said motor;

(c) readily releasable fastener means connected to said fluid introducing pad means for securing said fluid introducing pad means over the cooling intakes of said motor;

(d) a dispenser means connected to said fluid introducing pad means for controllably dispensing fluid; and (e) a control valve means connected to said fluid introducing pad means and in fluid communication with said conducting means for controllably introducing fluid into the cooling system of said motor.

3. The apparatus of claim 2 wherein said fluid introducing pad means are rectangular and said channel formed in said seal is diagonally across said fluid introducing pad means for covering various sizes and locations of cooling intakes on said motors for the introduction of fluid therein.

4. The apparatus of claim 3 wherein said ready releasable fastener means further comprises a slidable connection to said fluid introducing pad means to allow movement from varied motor intakes having different sizes and locations on said motor.

5. The apparatus of claim 4 wherein said dispenser means for controllably dispensing fluids further comprises (a) a fluid container; and (b) a valve means connected to said fluid introducing pad means for controllably connecting said fluid container in fluid communication with said fluid of said conducting means to form a mixture for introduction into said motor.

6. The apparatus of claim 5 wherein said valve means further comprises a valve connected to said fluid conducting means for controlling the flow of said fluid through said conducting means.

7. The apparatus of claim 6 wherein said ready releasable fastener means further comprises a pair of members having slotted channels for slidably moving said fluid introducing pad means therealong and releasable fastener means on said pair of members for joining said pair of members about said motor for positioning said fluid introducing pad means over said cooling intakes for the introduction of fluid therein.

8. The apparatus of claim 6 wherein said ready releasable fastener means further comprises an elastic member, slotted members on the other side of said fluid introducing pad means for receiving said elastic member and fastener means for releasably holding said elastic member and said fluid introducing pad member in place on said motor.

9. The apparatus of claim 6 wherein said fastener means for releasably holding said elastic member further comprises a washer-like member formed into a V shape for receiving said elastic member therethrough and holding said elastic member taut when said elastic member is stretched through said washer-like member and said member is pressed adjacent said motor.

10. The apparatus of claim 9 wherein the width of said elastic band is greater than the diameter of the hole in the washer-like member.

* * * * *